US011417288B1

(12) United States Patent
Chen

(10) Patent No.: US 11,417,288 B1
(45) Date of Patent: Aug. 16, 2022

(54) CONTROL CIRCUIT AND CONTROL METHOD APPLICABLE TO DISPLAY PANEL

(71) Applicant: Realtek Semiconductor Corp., HsinChu (TW)

(72) Inventor: Li-Ang Chen, HsinChu (TW)

(73) Assignee: Realtek Semiconductor Corp., HsinChu (TW)

( * ) Notice: Subject to any disclaimer, the term of this patent is extended or adjusted under 35 U.S.C. 154(b) by 0 days.

(21) Appl. No.: 17/505,655

(22) Filed: Oct. 20, 2021

(30) Foreign Application Priority Data

Feb. 4, 2021 (TW) ..... 110104171

(51) Int. Cl.
*G09G 3/36* (2006.01)
*G09G 3/34* (2006.01)

(52) U.S. Cl.
CPC ..... *G09G 3/36* (2013.01); *G09G 3/3406* (2013.01); *G09G 2310/08* (2013.01); *G09G 2320/0261* (2013.01); *G09G 2340/0435* (2013.01)

(58) Field of Classification Search
CPC ..... G09G 3/3611; G09G 2320/0261; G09G 2320/0266; G09G 2320/103; G09G 2340/0435; G09G 2320/0247; G09G 3/2025; G09G 3/3648
See application file for complete search history.

(56) References Cited

U.S. PATENT DOCUMENTS

2002/0030673 A1* 3/2002 Ikemoto ..... G09G 3/20 345/204
2002/0154102 A1* 10/2002 Huston ..... G09G 5/36 345/204
2004/0136686 A1* 7/2004 Kono ..... H04N 7/012 386/232
2007/0296668 A1* 12/2007 Kim ..... G09G 3/3611 345/89

FOREIGN PATENT DOCUMENTS

CN 102800288 B 3/2016
TW I694435 5/2020
TW I694436 5/2020

* cited by examiner

*Primary Examiner* — Shaheda A Abdin
(74) *Attorney, Agent, or Firm* — Winston Hsu

(57) ABSTRACT

The present invention provides a control circuit applied to a display panel, wherein the control circuit includes a receiving interface, an image processing circuit and a transmission interface. The receiving interface is configured to receive image data, wherein the image data has a variable frame rate. The image processing circuit is configured to receive the image data from the receiving interface, and perform a frequency multiplication operation on the image data according to a frame rate of the image data to generate output image data, wherein a frame rate of the output image data is a positive integer multiple of the frame rate of the image data. The transmission interface is configured to receive the output image data from the image processing circuit, and transmit the output image data to the display panel.

16 Claims, 8 Drawing Sheets

CONTROL CIRCUIT AND CONTROL METHOD APPLICABLE TO DISPLAY PANEL

BACKGROUND OF THE INVENTION

1. Field of the Invention

The present invention relates to a control circuit applicable to a display panel, and more particularly, to a control circuit capable of driving the display panel by frequency multiplication operation.

2. Description of the Prior Art

A display screen presented by a liquid crystal display (LCD) is generally known as a hold-type display. For displaying the screen being updated 60 times per second (60 Hz), the screen will be updated once per 16.67 milliseconds (ms). Before the screen is updated, the currently displayed screen is still. One of the biggest disadvantages of general LCDs is motion blur. The root cause of inducing the motion blur is that when eyes are tracking an object, they will focus on a current expected position of the object according to the moving rate of the object, and because the time for the LCD to update the screen is not continuous, there will be an error between the actual position of the object and the expected position of the object formed in the brain at a certain time point. On the other hand, because the human eye has visual persistence and dynamic compensation, the brain will perceive a succession of frames in the process of tracking the object (which is similar to the effect of integration of math). If the screen update frequency is not high enough and the screen stays in a single position for too long, the brain may see the effect of dynamic smear after compensation.

There have been prior art methods for solving motion blur, such as inserting a compensation frame or inserting a black frame between two frames. However, the liquid crystal display uses a row-by-row scanning method when displaying, and a response time of a liquid crystal may not be short enough. Therefore, the above method not only increases the calculation amount of the processing circuit, but also has a pixel synchronization problem, that is, the effect at the top of the screen and the bottom of the screen may be inconsistent.

In addition, in some applications, the speed at which the image source generates the image data is not fixed. Therefore, some LCD currently uses a display method of a variable refresh rate. The frame rate of frames displayed by the LCD changes with the rate of the received image data, that is, the frame rate is not fixed. In this state, how to effectively solve motion blur is an important issue.

SUMMARY OF THE INVENTION

One of the objectives of the present invention is to provide a control circuit capable of driving a display panel by a frequency multiplication operation when an image data has a variable frame rate, to solve the aforementioned problem.

At least one embodiment of the present invention provides a control circuit applicable to a display panel. The control circuit comprises a receiving interface, an image processing circuit and a transmission interface. The receiving interface is configured to receive image data. The image data has a variable frame rate. The image processing circuit is coupled to the receiving interface. The image processing circuit is configured to receive the image data from the receiving interface, and the image processing circuit performs a frequency multiplication operation on the image data according to a frame rate of the image data to generate output image data. A frame rate of the output image data is a positive integer multiple of the frame rate of the image data. The transmission interface is coupled to the image processing circuit. The transmission interface is configured to receive the output image data from the image processing circuit, and transmit the output image data to the display panel.

At least one embodiment of the present invention provides a control method applicable to a display panel. The control method comprises: receiving image data, wherein the image data has a variable frame rate; performing a frequency multiplication operation on the image data according to a frame rate of the image data to generate output image data, wherein a frame rate of the output image data is a positive integer multiple of the frame rate of the image data; and transmitting the output image data to the display panel.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
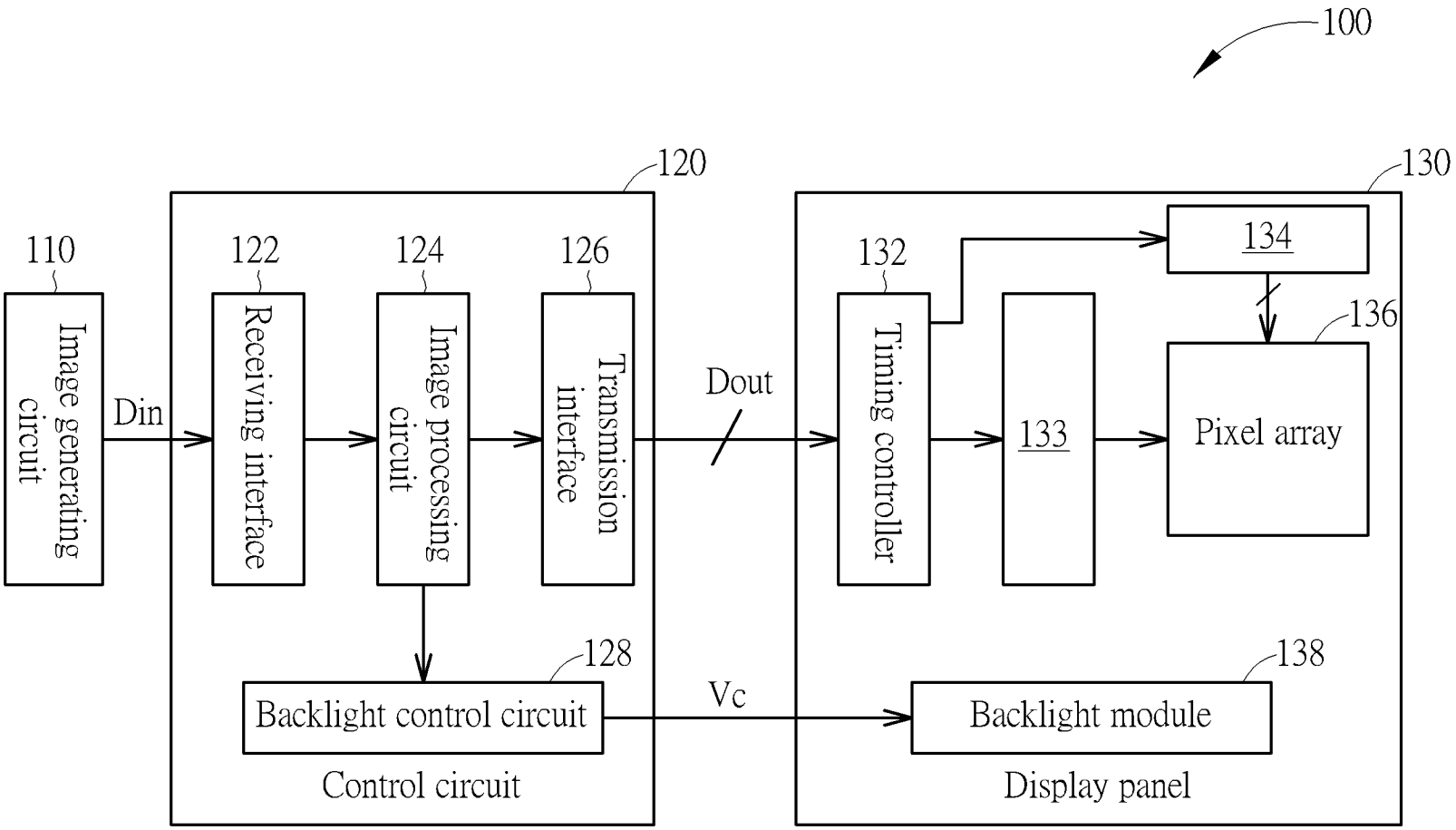
FIG. 1 is a diagram illustrating an electronic device according to an embodiment of the present invention.

FIG. 1 is a diagram illustrating an electronic device 100 according to an embodiment of the present invention. As shown in FIG. 1, the electronic device 100 comprises an image generating circuit 110, a control circuit 120 and a display panel 130. In the present embodiment, the image generating circuit 110 may be a graphics processing unit (GPU) configured to generate image data Din, and the format of the image data Din conforms to a specification of Display Port (DP) or a specification of High Definition Multimedia Interface (HDMI), but the present invention is not limited thereto. The control circuit 120 includes a receiving interface 122, an image processing circuit 124, a transmission interface 126 and a backlight control circuit 128, where the receiving interface 122 is configured to receive the image data Din from the image generating circuit 110 and send it to the image processing circuit 124 for image processing. The image processing circuit 124 can adjust the brightness, color, frame rate/refresh rate or other formats of the received image data Din to generate output image data Dout to the transmission interface 126, where the output image data Dout is to be transmitted to the display panel 130 for displaying. In addition, the backlight control circuit 128 is used to generate a control signal Vc to control the brightness of the display panel 130, where the control signal Vc may be a pulse-width modulation (PWM) signal. In the present embodiment, the output image data Dout can be a panel signal conforming to any specification, such as a specification of Low Voltage Differential Signaling (LVDS), a specification of V-by-One, a specification of embedded Display Port (eDP), etc. The display panel 130 is a liquid crystal display panel, and includes a timing controller 132, a gate driver 133, a source driver 134, a pixel array 136 and a backlight module 138, where the timing controller 132 receives the output image data Dout from the control circuit 122 and generates and outputs a corresponding gate driving signal and a corresponding source driving signal to the gate driver 133 and the source driver 134, respectively, for enabling the pixel array 136 to display an image; in addition, the backlight module 138 receives the control signal Vc to display corresponding brightness.

The electronic device 100 shown in FIG. 1 supports a display method of variable refresh rate, that is, the frame rate of the output image data Dout generated by the control circuit 120 changes with the frame rate of the image data Din generated by the image generating circuit 110. In some embodiments, the time for the image generating circuit 110 to generate each frame is not fixed. Therefore, the control circuit 120 is designed to support a larger range of frame rates, such as 48 Hz to 144 Hz or higher 240 Hz, such that users can perceive that the display screen has improved smoothness. However, although the control circuit 120 can support a higher frame rate, the frame rate of the image data Din output by the image generating circuit 110 is usually around 60 Hz. Therefore, this embodiment provides a control method which can adjust the frame rate of the image data Din by performing frequency multiplication to generate the output image data Dout when the frame rate of the image data Din output by the image generating circuit 110 is stably lower than the frame rate which the control circuit 120 may support, to solve the problem of motion blur described in the prior art. The embodiments are as follows.

Figure 2:
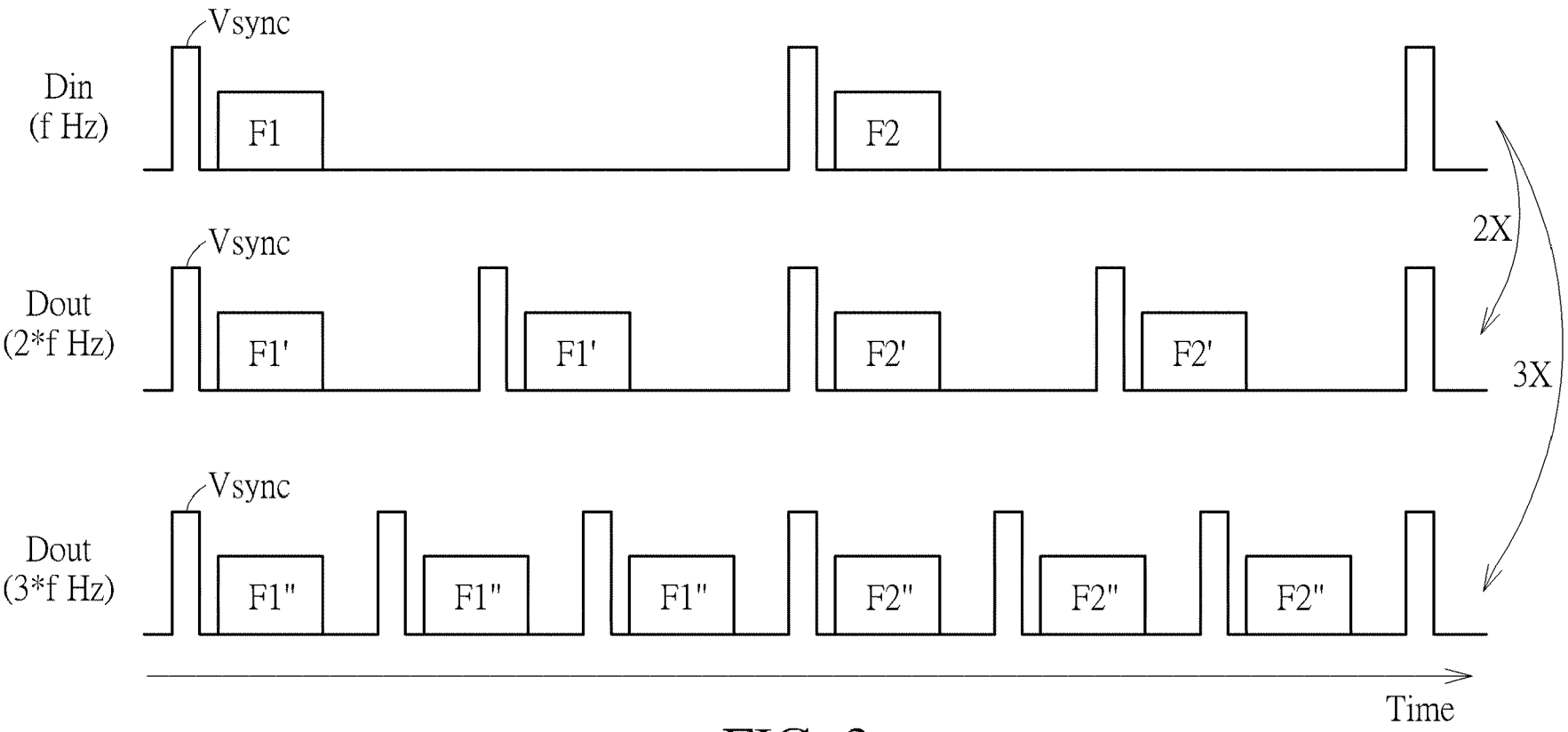
FIG. 2 is a diagram illustrating timing of operations of the control circuit according to an embodiment of the present invention.

FIG. 2 is a diagram illustrating timing of operations of the control circuit 120 according to an embodiment of the present invention. As shown in FIG. 2, assuming that the frame rate of the image data Din generated by the image generating circuit 110 is 'f' (the unit of 'f' can be frame per second (fps) or hertz (Hz)), after the control circuit 120 receives the image data Din, the image processing circuit 124 thereof can directly perform frequency multiplication by 2 on the image data Din, that is, the frame rate of the output image data Dout is "2*f" (that is, the time difference between two adjacent vertical synchronization signals Vsync of the output image data Dout is half of the time difference between two adjacent vertical synchronization signals Vsync of the image data Din); or the image processing circuit 124 can directly perform frequency multiplication by 3 on the image data Din, that is, the frame rate of the output image data Dout is '3*f'(that is, the time difference between two adjacent vertical synchronization signals Vsync of the output image data Dout is one third of the time difference between two adjacent vertical synchronization signals Vsync of the image data Din); or the image processing circuit 124 can directly perform frequency multiplication by N on the image data Din, where N is any suitable positive integer, as long as the frame rate of the output image data Dout is lower than the highest frame rate which the control circuit 120 and the display panel 130 may support.

In the embodiment of FIG. 2, the image processing circuit 124 directly copies the image data when performing the frequency multiplication operation. Taking frequency multiplication by 2 as an example, when a frame F1 is received, the image processing circuit 124 directly transmits the content corresponding to the active area in the frame F1 to the display panel 130 twice, such that the output image data Dout includes two frames F1' (i.e., frequency-multiplied frames), where the content of the active area of each frame F1' (that is, a portion displayed in the pixel array 136) is the same as the content of the active area of the frame F1. Similarly, when a frame F2 is received, the image processing circuit 124 directly transmits the content corresponding to the active area in the frame F2 to the display panel 130 twice, such that the output image data Dout includes two frames F2' (i.e., frequency-multiplied frames), where the content of the active area of each frame F2' is the same as the content of the active area of frame F2. In addition, taking the frequency multiplication by 3 as an example, when the frame F1 is received, the image processing circuit 124 directly transmits the content of the active area of the frame F1 to the display panel 130 three times, such that the output image data Dout includes three frames F1" (i.e., frequency-multiplied frames), the content of the active area of each frame F1" is the same as the content of the active area of frame F1. Similarly, when the frame F2 is received, the image processing circuit 124 also directly transmits the content of the active area of the frame F2 to the display panel 130 three times, such that the output image data Dout includes three frames F2" (i.e., frequency-multiplied frames). In the control method of this embodiment, the output image data Dout is generated by directly preforming the frequency multiplication operation on the image data Din. Generally speaking, each pixel in the pixel array 136 cannot reach required brightness at one time due to the response speed of the liquid crystal (that is, the pixel electrode in the pixel cannot directly reach the required target voltage level within one period). Therefore, through directly preforming the frequency multiplication operation on the image data Din to drive the pixel electrode to a same target voltage level multiple times, the color/brightness of the display panel 130 can be more accurate.

Figure 6:
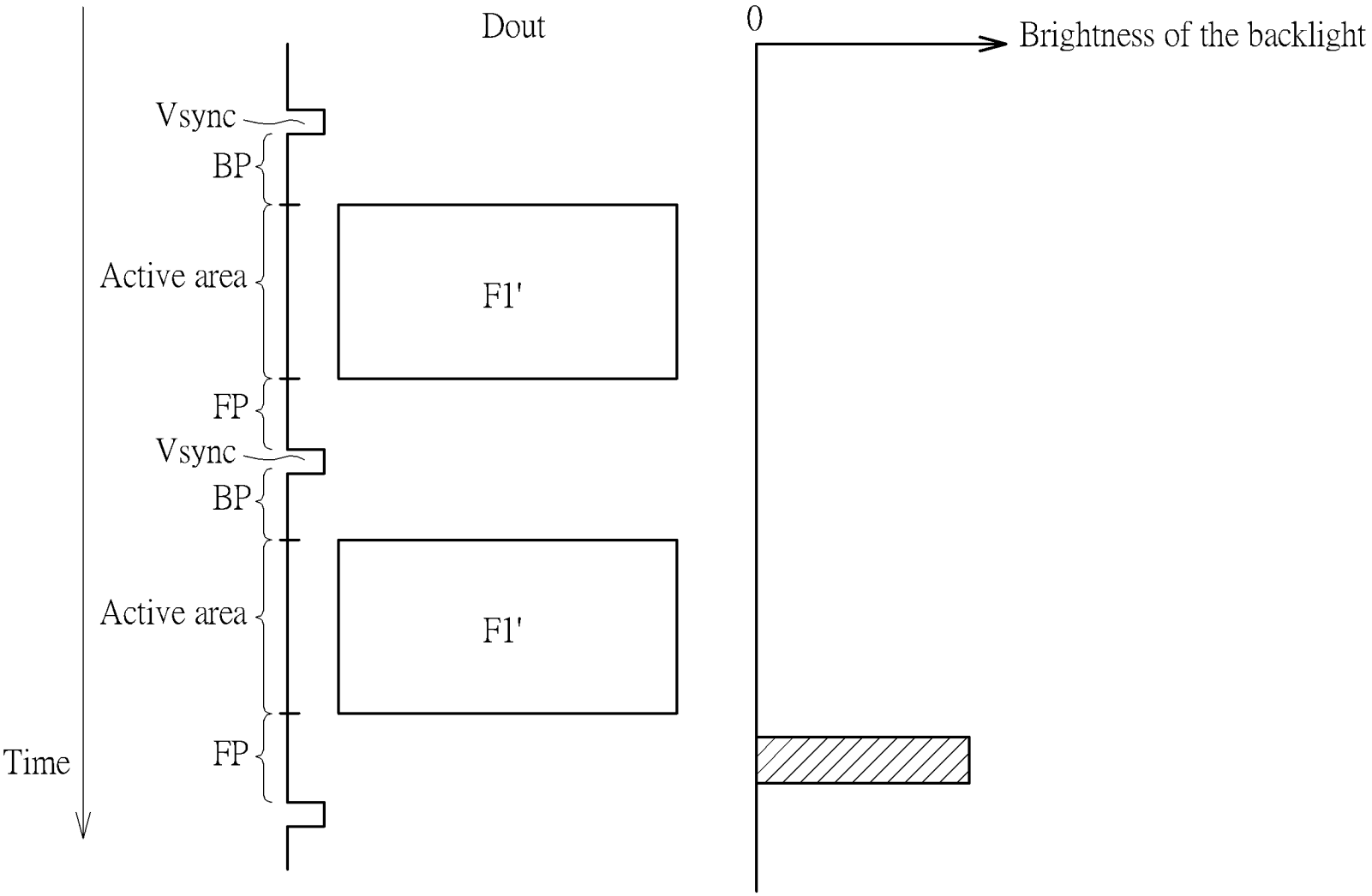
FIG. 6 is a diagram illustrating timing of operations of the control circuit according to yet another embodiment of the present invention.

In addition, in one embodiment, the frequency multiplication operation on the image data Din for generating the output image data Dout can be performed by reducing the content of front porch (FB) area (please refer to FIG. 6), or by changing the frequency of the clock signal used to transmit the output image data Dout.

Figure 3:
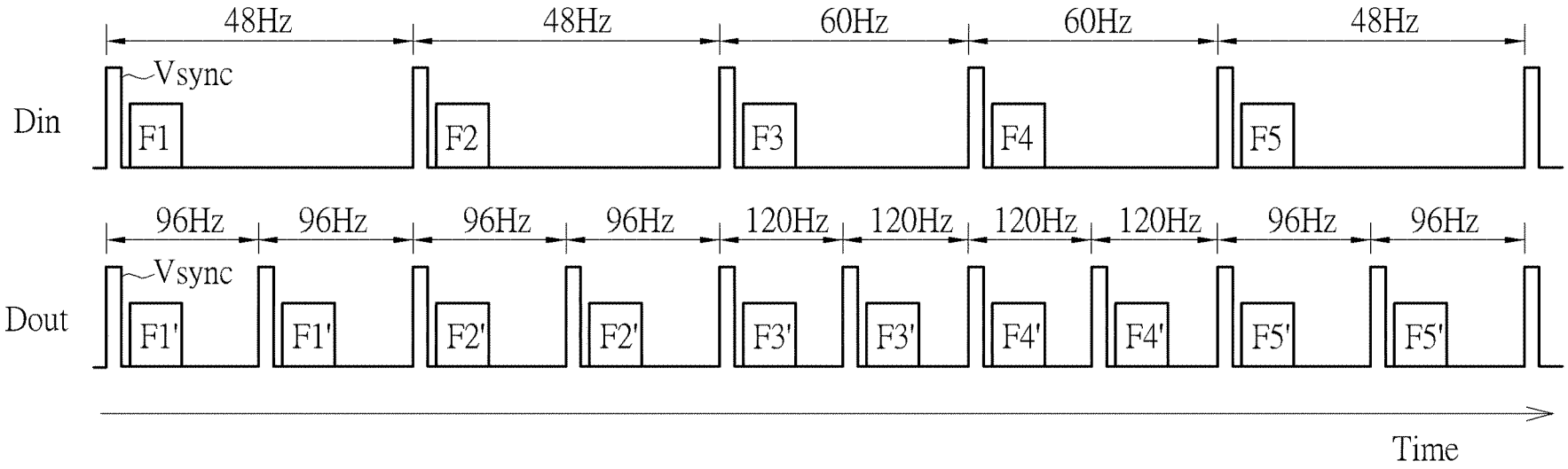
FIG. 3 is a diagram illustrating timing of operations of the control circuit according to another embodiment of the present invention.

FIG. 3 is a diagram illustrating timing of operations of the control circuit 120 according to another embodiment of the present invention. Frequency multiplication by 2 is taken as an example in FIG. 3, but the present invention is not limited thereto. As shown in FIG. 3, it is assumed that the image data Din generated by the image generating circuit 110 sequentially includes frames F1 to F5, where the frame rates of the frames F1 to F5 are 48 Hz, 48 Hz, 60 Hz, 60 Hz, and 48 Hz, respectively, and the image processing circuit 124 can directly perform frequency multiplication by 2 on the image data Din, that is, the output image data Dout sequentially includes frames F1' (96 Hz), F1' (96 Hz), F2' (96 Hz), F2' (96 Hz), F3' (120 Hz), F3' (120 Hz), F4' (120 Hz), F4' (120 Hz), F5' (96 Hz) and F5' (96 Hz). Through the control method of the present embodiment, when the image data Din has a variable frame rate, the output image data Dout can be dynamically generated according to the frame rate of the image data Din.

Figure 4:
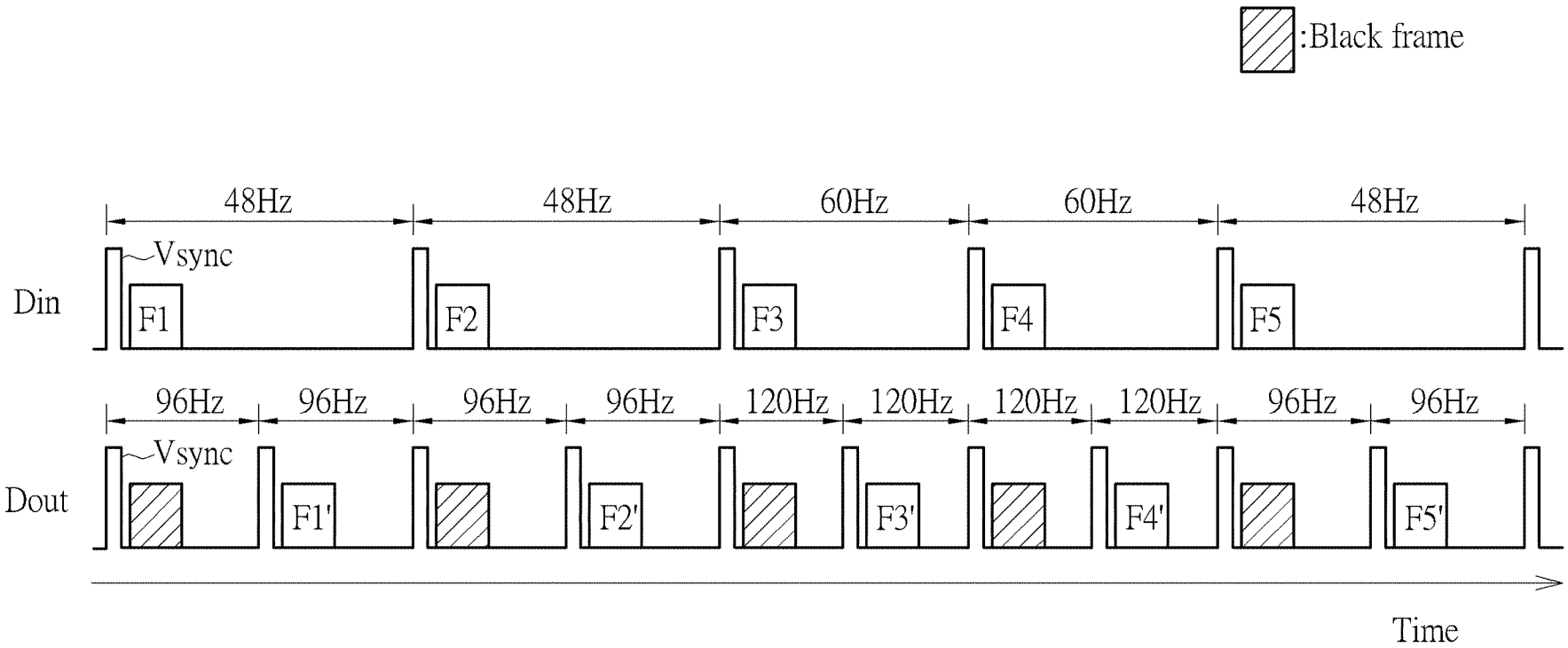
FIG. 4 is a diagram illustrating timing of operations of the control circuit according to yet another embodiment of the present invention.

FIG. 4 is a diagram illustrating timing of operations of the control circuit 120 according to yet another embodiment of the present invention. Frequency multiplication by 2 is taken as an example in FIG. 4, but the present invention is not limited thereto. As shown in FIG. 4, it is assumed that the image data Din generated by the image generating circuit 110 sequentially includes frames F1 to F5, where the frame rates of the frames F1 to F5 are 48 Hz, 48 Hz, 60 Hz, 60 Hz and 48 Hz, respectively, and the image processing circuit 124 performs frequency multiplication by 2 on the image data Din and also performs a black frame insertion operation, that is, the output image data Dout sequentially includes a black frame (96 Hz), the frame F1' (96 Hz), a black frame (96 Hz), the frame F2' (96 Hz), a black frame (120 Hz), the frame F3' (120 Hz), a black frame (120 Hz), the frame F4' (120 Hz), a black frame (96 Hz) and the frame F5' (96 Hz). Through the control method of the present embodiment, when the image data Din has a variable frame rate, the output image data Dout can be dynamically generated according to the frame rate of the image data Din. Furthermore, the black frame insertion operation inserts black frames into the repeated frames, to reduce the motion blur caused by vision persistence.

It should be noted that the black frame described in FIG. 4 is not necessarily a completely black frame, as long as the brightness of the black frames is much lower than the brightness of the frames F1 to F5.

In one embodiment, if the image processing circuit 124 performs frequency multiplication by N on a frame and black frame insertion to generate N frequency-multiplied frames (N is any positive integer greater than one), a first frequency-multiplied frame in the N frequency-multiplied frames is a black frame, and the content of an active area of a last frequency-multiplied frame in the N frequency-multiplied frames is the same as the content of the active area of the frame.

Figure 5:
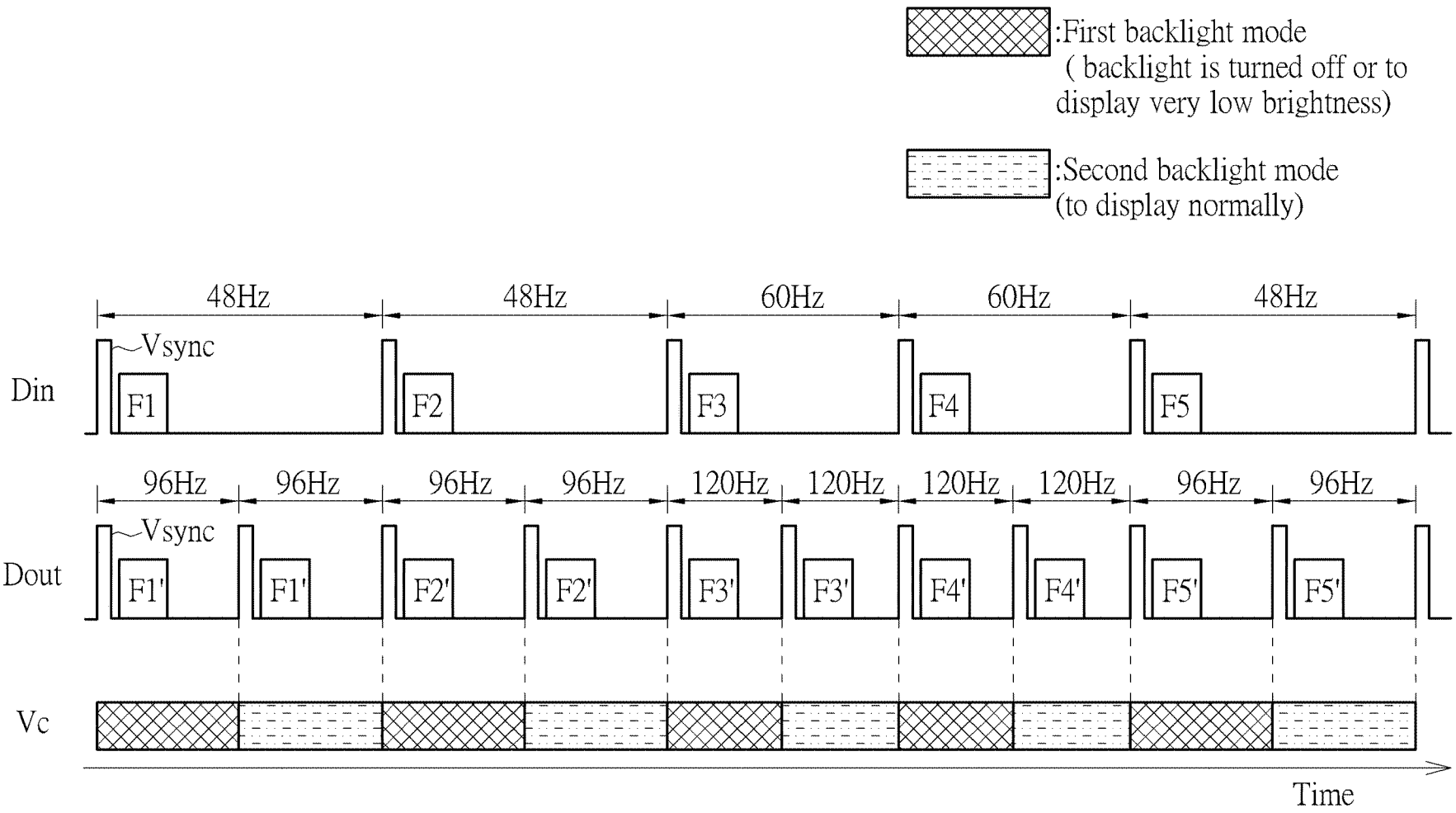
FIG. 5 is a diagram illustrating timing of operations of the control circuit according to yet another embodiment of the present invention.

FIG. 5 is a diagram illustrating timing of operations of the control circuit 120 according to yet another embodiment of the present invention. Frequency multiplication by 2 is taken as an example in FIG. 5, but the present invention is not limited thereto. As shown in FIG. 5, it is assumed that the image data Din generated by the image generating circuit 110 sequentially includes frames F1 to F5, where the frame rates of the frames F1 to F5 are 48 Hz, 48 Hz, 60 Hz, 60 Hz, and 48 Hz, respectively, and the image processing circuit 124 can directly perform frequency multiplication by 2 on the image data Din, that is, the output image data Dout sequentially includes frames F1' (96 Hz), F1' (96 Hz), F2' (96 Hz), F2' (96 Hz), F3' (120 Hz), F3' (120 Hz), F4' (120 Hz), F4' (120 Hz), F5' (96 Hz) and F5' (96 Hz). In addition, the backlight control module 128 of the control circuit 120 generates a control signal Vc to adopt a first backlight mode or a second backlight mode for different frames. In the first backlight mode, the backlight module 138 is controlled to be completely turned off or to display very low brightness. In the second backlight mode, the backlight module 138 is controlled to display normal brightness. Specifically, when the display panel 130 displays the frame F1' which is displayed for the first time, the backlight control module 128 generates a control signal Vc to control the backlight module 138 to operate in the first backlight mode, that is, the frame F1' that is displayed for the first time can be regarded as a black frame; and when the display panel 130 displays the frame F1' which is displayed for the second time, the backlight control module 128 generates the control signal Vc to control the backlight module 138 to operate in the second backlight mode, that is, the display panel 130 normally displays the frame F1' which is displayed for the second time. According to the same operation, when the display panel 130 respectively displays the frames F2', F3', F4' and F5' for the first time, the backlight control module 128 generates the control signal Vc to control the backlight module 138 to operate in the first backlight mode, that is, the frames F2', F3', F4', and F5' displayed for the first time can be regarded as black frames; and when the display panel 130 respectively displays the frames F2', F3', F4 and F5' for the second time, the backlight control module 128 generates the control signal Vc to control the backlight module 138 to operate in the second backlight mode, that is, the display panel 130 normally displays the frames F2', F3', F4' and F5' that are displayed for the second time.

In one embodiment, if the image processing circuit 124 performs frequency multiplication by N on a frame and black frame insertion to generate N frequency-multiplied frames (N is any positive integer greater than one), when the transmission interface 126 transmits a first frequency-multiplied frame of the N frequency-multiplied frames to the display panel 130, the backlight control module 128 generates the control signal Vc to control the backlight module 137 to operate in the first backlight mode; and when the transmission interface 126 transmits a last frequency-multiplied frame of the N frequency-multiplied frames to the display panel 130, the backlight control module 128 generates a control signal Vc to control the backlight module 138 to operate in the second backlight mode.

In one embodiment, the backlight control method shown in FIG. 5 may be a strobe backlight control method. Specifically, referring to FIG. 6, each complete frame sequentially includes a vertical synchronization signal Vsync, a back porch (BP) area, an active area (that is, the content displayed on the pixel array 136) and a front porch (FP) area. When the display panel 130 displays the frame F1' which is displayed for the first time, the backlight control module 128 generates the control signal Vc to control the brightness of the backlight module 138 to be 0 or a very low brightness value, such that the frame F1' which is displayed for the first time can be regarded as a black frame. Next, when the display panel 130 displays the frame F1' which is displayed for the second time, the backlight control module 128 generates the control signal Vc, to control the backlight module 138 to temporarily provide illumination for the display panel 130 to display the frame F1' (which is displayed for the second time) after the pixel array 136 of the display panel 130 completely receives a driving signal of the frame F1' (which is displayed for the second time).

Figure 7:
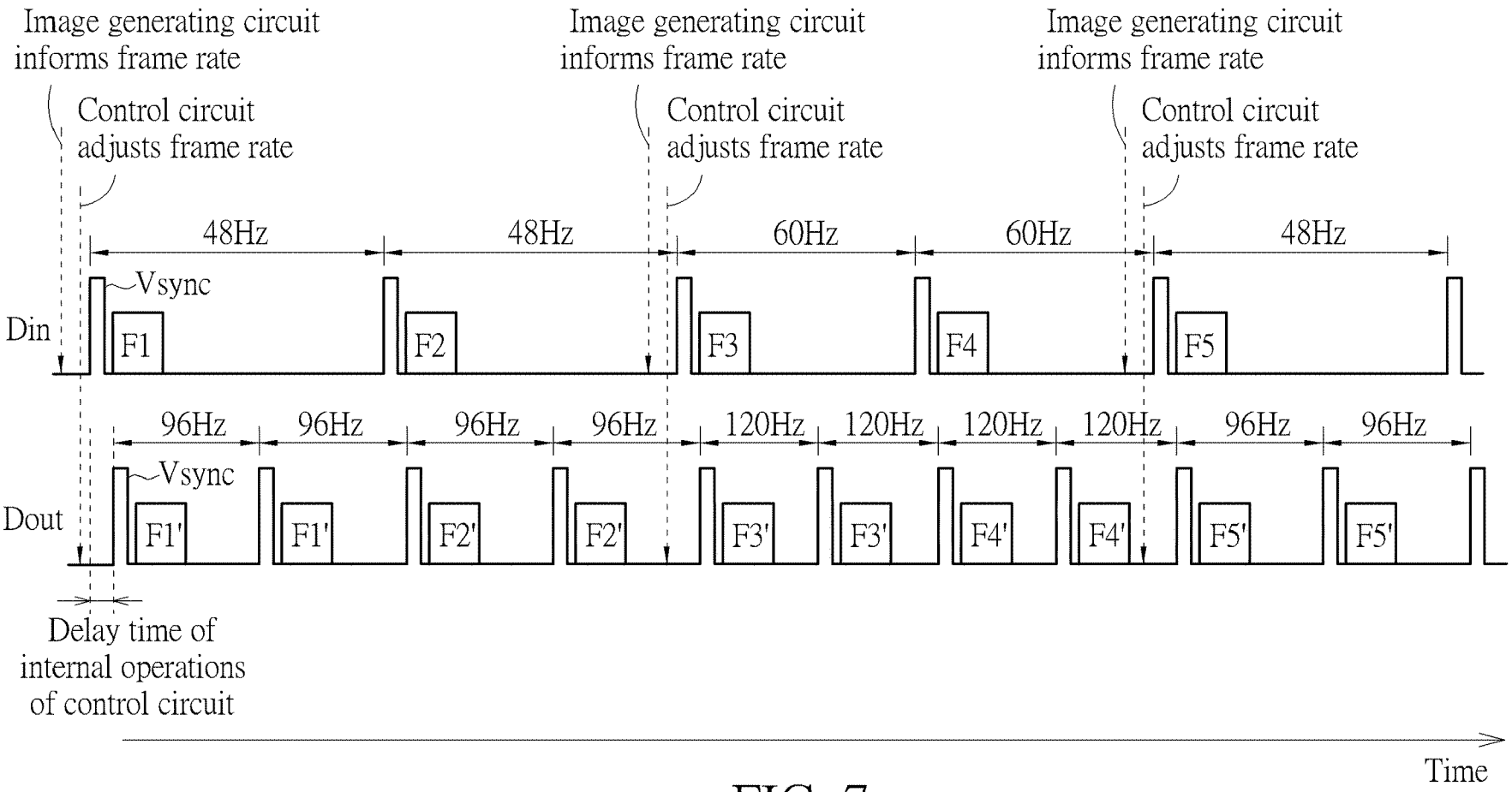
FIG. 7 is a diagram illustrating timing of operations of the control circuit according to yet another embodiment of the present invention.

FIG. 7 is a diagram illustrating timing of operations of the control circuit 120 according to yet another embodiment of the present invention. Frequency multiplication by 2 is taken as an example in FIG. 7, but the present invention is not limited thereto. As shown in FIG. 7, before transmitting the frame F1, the image generating circuit 110 first informs the control circuit 120 of the frame rate (such as 48 Hz) of the frame F1 to be transmitted next for allowing the control circuit 120 to settle the current frame rate (such as 96 Hz). After a period of delay time of internal operations, the image processing circuit 124 of the control circuit 120 sequentially outputs two frames F1' with a frame rate of 96 Hz. Since the frame rate of the frame F2 is the same as the frame rate of the frame F1, the image generating circuit 110 does not inform the control circuit 120 of the frame rate of the frame F2 to be transmitted next, and the image processing circuit 124 further uses the previous frame rate (such as 96 Hz) to sequentially output two frames F2' with a frame rate of 96 Hz. Then, before transmitting the frame F3, the image generating circuit 110 informs the control circuit 120 of the frame rate (such as 60 Hz) of the frame F3 to be transmitted next for allowing the control circuit 120 to settle the current frame rate (such as 120 Hz). After a period of delay time of internal operations, the image processing circuit 124 of the control circuit 120 sequentially outputs two frames F3' with a frame rate of 120 Hz. Since the frame rate of the frame F4 is the same as the frame rate of the frame F3, the image generating circuit 110 does not inform the control circuit 120 of the frame rate of the frame F4 to be transmitted next, and the image processing circuit 124 further uses the previous frame rate (such as 120 Hz) to sequentially output two frames F4' with a frame rate of 120 Hz. Then, before transmitting the frame F5, the image generating circuit 110 informs the control circuit 120 of the frame rate (such as 48 Hz) of the frame F5 to be transmitted next for allowing the control circuit 120 to settle the current frame rate (such as 96 Hz). After a period of delay time of internal operations, the image processing circuit 124 of the control circuit 120 sequentially outputs two frames F5' with a frame rate of 120 Hz.

In the embodiment of FIG. 7, the image generating circuit 110 informs the control circuit 120 only when there is a frame rate change of generated frames. However, this feature is not a limitation of the present invention. In other embodiments, the image generating circuit 110 may inform the control circuit 120 of the frame rate of each frame to be transmitted before transmitting the frame. These alternative designs all belong to the scope of the present invention.

It should be noted that the embodiment shown in FIG. 7 can also be applied to the method of inserting black frames as shown in FIGS. 4 and 5. That is, the frames F1' to F5' which are displayed for the first time in the output image data Dout shown in FIG. 7 are replaced with black frames as shown in FIG. 4, or as shown in FIG. 5, when the display panel 130 displays the frames F1' to F5' which are displayed for the first time, the backlight control module 128 generates a control signal Vc to control the backlight module 138 to operate in the first backlight mode, that is, the frames F1' to F5' which are displayed for the first time can be regarded as black frames; and when the display panel 130 displays the frames F1' to F5' which are displayed for the second time, the backlight control module 128 generates the control signal Vc to control the backlight module 138 to operate in the second backlight mode, that is, the display panel 130 normally displays the frames F1' to F5' which are displayed for the second time.

Figure 8:
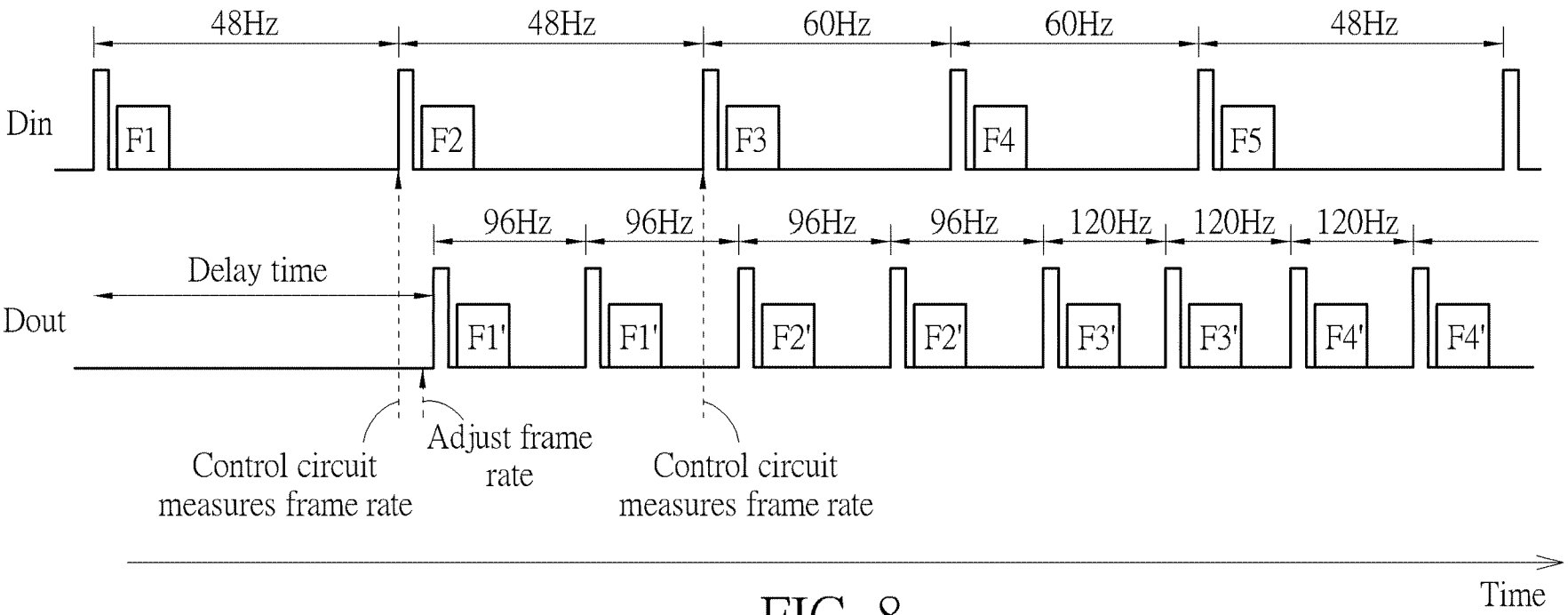
FIG. 8 is a diagram illustrating timing of operations of the control circuit according to yet another embodiment of the present invention.

FIG. 8 is a diagram illustrating timing of operations of the control circuit 120 according to yet another embodiment of the present invention. Frequency multiplication by 2 is taken as an example in FIG. 8, but the present invention is not limited thereto. As shown in FIG. 8, the image generating circuit 110 first transmits the frame F1 to the control circuit 120, and the image processing circuit 124 temporarily stores the frame F1 into an internal buffer, and does not start to measure the frame rate (such as 48 Hz) of the frame F1 to settle the current frame rate (such as 96 Hz) until transmission of the frame F1 is completed (for example, after receiving the next vertical synchronization signal Vsync). After a period of delay time of internal operations, the image processing circuit 124 of the control circuit 120 sequentially outputs two frames F1' with a frame rate of 96 Hz. Then, the image generating circuit 110 transmits the frame F2 to the control circuit 120, and the image processing circuit 124 temporarily stores the frame F2 into the internal buffer, and does not start to measure the frame rate (such as 48 Hz) of the frame F2 to settle the current frame rate (such as 96 Hz) until transmission of the frame F2 is completed. After a period of delay time of internal operations, the image processing circuit 124 of the control circuit 120 sequentially outputs two frames F2' with a frame rate of 96 Hz. Similarly, the image generating circuit 110 transmits the frame F3 to the control circuit 120, and the image processing circuit 124 temporarily stores the frame F3 into the internal buffer, and does not start to measure the frame rate (such as 60 Hz) of the frame F3 to settle the current frame rate (such as 120 Hz) until transmission of the frame F3 is completed. After a period of delay time of internal operations, the image processing circuit 124 of the control circuit 120 sequentially outputs two frames F3' with a frame rate of 120 Hz. According to similar operations as described above, the image processing circuit 124 sequentially outputs two frames F4' with a frame rate of 120 Hz after the content of the frame F4 is completely received, and sequentially outputs two frames F5' with a frame rate of 96 Hz after the content of the frame F5 is completely received.

It should be noted that the embodiment shown in FIG. 8 can also be applied to the method of inserting black screens shown in FIGS. 4 and 5. That is, the frames F1' to F5' which are displayed for the first time in the output image data Dout shown in FIG. 8 are replaced with black frames as shown in FIG. 4, or as shown in FIG. 5, when the display panel 130 displays the frames F1' to F5' which are displayed for the first time, the backlight control module 128 generates a control signal Vc to control the backlight module 138 to operate in the first backlight mode, that is, the frames F1' to F5' which are displayed for the first time can be regarded as black frames; and when the display panel 130 displays the frames F1' to F5' which are displayed for the second time, the backlight control module 128 generates the control signal Vc to control the backlight module 138 to operate in the second backlight mode, that is, the display panel 130 normally displays the frames F1' to F5' which are displayed for the second time.

It should be noted that in the above embodiments, it is assumed that the frame rate of the image data Din output by the image generating circuit 110 is stably lower than the frame rate which the control circuit 120 may support. Therefore, the frequency multiplication method is used to adjust the frame rate of the image data Din to generate the output image data Dout, to solve the problem of motion blur described in the prior art. However, if the image processing circuit 124 determines that the currently received image data Din does not conform to a specification of the frequency multiplication (for example, the frame rate of some frames in the image data Din is close to or higher than a half of the frame rate which the control circuit 120 may support), the image processing circuit 124 can stop the frequency multiplication operation described above, that is, the frame rate of the output image data Dout is the same as the frame rate of the image data Din.

Briefly summarizing the present invention, in the control circuit and control method applicable to a display panel of the present invention, the frequency multiplication operation is performed according to the frame rate of the image data to generate the output image data, and then the black frame insertion operation is further performed, to effectively reduce the motion blur on the display of the liquid crystal display panel for improving the display quality.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A control circuit applicable to a display panel, the control circuit comprising:

a receiving interface, configured to receive image data, wherein the image data has a variable frame rate; an image processing circuit, coupled to the receiving interface, wherein the image processing circuit is configured to receive the image data from the receiving interface, and perform a frequency multiplication operation on the image data according to a frame rate of the image data to generate output image data, wherein a frame rate of the output image data is a positive integer multiple of the frame rate of the image data; and a transmission interface, coupled to the image processing circuit, wherein the transmission interface is configured to receive the output image data from the image processing circuit, and transmit the output image data to the display panel;

wherein the image data comprises a first frame, and the image processing circuit performs the frequency multiplication operation on the first frame to generate N frequency-multiplied first frames, where N is a positive integer greater than one.

2. The control circuit of claim 1, wherein a content of an active area of each frequency-multiplied first frame is the same as a content of an active area of the first frame.

3. The control circuit of claim 2, wherein the image data comprises a second frame, a frame rate of the second frame is different from a frame rate of the first frame, and the image processing circuit performs the frequency multiplication operation on the second frame to generate N frequency-multiplied second frames, wherein a content of an active area of each frequency-multiplied second frame is the same as a content of an active area of the second frame.

4. The control circuit of claim 1, wherein a first frequency-multiplied first frame of the N frequency-multiplied first frames is a black frame, and a content of an active area of a last frequency-multiplied first frame of the N frequency-multiplied first frames is the same as a content of an active area of the first frame.

5. The control circuit of claim 1, further comprising:

a backlight control module, configured to generate a control signal to control brightness of a backlight module of the display panel;

wherein when the transmission interface transmits a first frequency-multiplied first frame of the N frequency-multiplied first frames to the display panel, the backlight control module generates the control signal to control the backlight module to operate in a first backlight mode; and when the transmission interface transmits a last frequency-multiplied first frame of the N frequency-multiplied first frames to the display panel, the backlight control module generates the control signal to control the backlight module to operate in a second backlight mode different from the first backlight mode, wherein the brightness of the backlight module under the first backlight mode is lower than the brightness of the backlight module under the second backlight mode.

6. The control circuit of claim 1, wherein before starting to receive the first frame, the receiving interface receives information to obtain a frame rate of the first frame, and the image processing circuit performs the frequency multiplication operation on the first frame according to the frame rate of the first frame to generate the N frequency-multiplied first frames, and sequentially transmits the N frequency-multiplied first frames to the display panel.

7. The control circuit of claim 6, wherein the image processing circuit starts to generate the first frequency-multiplied first frame of the N frequency-multiplied first frames before receiving all contents of the first frame, and further transmits the first frequency-multiplied first frame to the display panel.

8. The control circuit of claim 1, wherein after receiving all contents of the first frame, the image processing circuit measures a frame rate of the first frame, and performs the frequency multiplication operation on the first frame according to the frame rate of the first frame to generate the N frequency-multiplied first frames, and sequentially transmits the N frequency-multiplied first frames to the display panel.

9. A control method applicable to a display panel, the control method comprising:

receiving image data, wherein the image data has a variable frame rate;

performing a frequency multiplication operation on the image data according to a frame rate of the image data to generate output image data, wherein a frame rate of the output image data is a positive integer multiple of the frame rate of the image data; and transmitting the output image data to the display panel;

wherein the image data comprises a first frame, and the frequency multiplication operation is performed on the first frame to generate N frequency-multiplied first frames, where N is a positive integer greater than one.

10. The control method of claim 9, wherein a content of an active area of each frequency-multiplied first frame is the same as a content of an active area of the first frame.

11. The control method of claim 10, wherein the image data comprises a second frame, a frame rate of the second frame is different from a frame rate of the first frame, and the frequency multiplication operation is performed on the second frame to generate N frequency-multiplied second frames, wherein a content of an active area of each frequency-multiplied second frame is the same as a content of an active area of the second frame.

12. The control method of claim 9, wherein a first frequency-multiplied first frame of the N frequency-multiplied first frames is a black frame, and a content of an active area of a last frequency-multiplied first frame of the N frequency-multiplied first frames is the same as a content of an active area of the first frame.

13. The control method of claim 9, further comprising:

generating a control signal to control brightness of a backlight module of the display panel;

wherein when a first frequency-multiplied first frame of the N frequency-multiplied first frames is transmitted to the display panel, the control signal is generated to control the backlight module to operate in a first backlight mode; and when a last frequency-multiplied first frame of the N frequency-multiplied first frames is transmitted to the display panel, the control signal is generated to control the backlight module to operate in a second backlight mode different from the first backlight mode, wherein the brightness of the backlight module under the first backlight mode is lower than the brightness of the backlight module under the second backlight mode.

14. The control method of claim 9, wherein performing the frequency multiplication operation on the image data according to the frame rate of the image data to generate the output image data comprises:

before starting to receive the first frame, receiving information to obtain a frame rate of the first frame;

wherein the frequency multiplication operation is performed on the first frame according to the frame rate of the first frame to generate the N frequency-multiplied first frames, the N frequency-multiplied first frames are sequentially transmitted to the display panel.

15. The control method of claim 14, wherein generation of first frequency-multiplied first frame of the N frequency-multiplied first frames starts before all contents of the first frame are received, and the first frequency-multiplied first frame is transmitted to the display panel.

16. The control method of claim 9, wherein performing the frequency multiplication operation on the image data according to the frame rate of the image data to generate the output image data comprises:

after receiving all contents of the first frame, measuring a frame rate of the first frame, wherein the frequency multiplication operation is performed on the first frame according to the frame rate of the first frame to generate the N frequency-multiplied first frames, and the N frequency-multiplied first frames are sequentially transmitted to the display panel.

* * * * *